US010827593B1

(12) United States Patent
Lai

(10) Patent No.: US 10,827,593 B1
(45) Date of Patent: Nov. 3, 2020

(54) LED LIGHTING SYSTEM, LED DEVICE, AND LED ADDRESS WRITING METHOD

(71) Applicant: POWER MOS ELECTRONICS LIMITED, Kowloon (HK)

(72) Inventor: Cheng-Chang Lai, Taipei (TW)

(73) Assignee: POWER MOS ELECTRONICS LIMITED, Kowloon (HK)

( * ) Notice: Subject to any disclaimer, the term of this patent is extended or adjusted under 35 U.S.C. 154(b) by 0 days.

(21) Appl. No.: 16/820,950

(22) Filed: Mar. 17, 2020

(51) Int. Cl.
*H05B 47/165* (2020.01)
*H05B 45/44* (2020.01)
*H05B 45/20* (2020.01)

(52) U.S. Cl.
CPC ..... *H05B 47/165* (2020.01); *H05B 45/20* (2020.01); *H05B 45/44* (2020.01)

(58) Field of Classification Search
CPC ..... H05B 45/44; H05B 47/165
See application file for complete search history.

(56) References Cited

U.S. PATENT DOCUMENTS 10,561,005 B1 * 2/2020 Peng ..... H05B 47/155

* cited by examiner

*Primary Examiner* — Seokjin Kim
(74) *Attorney, Agent, or Firm* — Birch, Stewart, Kolasch & Birch, LLP

(57) ABSTRACT

The LED lighting system includes a plurality of LED devices and a main controller, the LED devices are connected in parallel, and are connected to the main controller. The main controller includes a main processing unit. The main processing unit determines whether a total consumption of the LED devices increases by a first predetermined value; when the total consumption increases by the first predetermined value, the main processing unit generates an address writing signal, and sends the address writing signal to the LED devices. Only the LED device with an empty LED memory unit, which is the newly installed LED device, will store an address code according to the address writing signal. Since the address code is given to the new LED device automatically by the main processing unit, the user can independently install a new LED device to the LED lighting system without professional help.

17 Claims, 5 Drawing Sheets

LED LIGHTING SYSTEM, LED DEVICE, AND LED ADDRESS WRITING METHOD

BACKGROUND OF THE INVENTION

1. Field of the Invention

The present invention relates to an LED lighting system, and particular to an LED lighting system with an LED address writing function.

2. Description of the Related Art

A conventional lighting system includes a plurality of LED devices and a controller. The controller is electrically connected to the LED devices, and each LED device includes a driver IC and RGB LED chips. The driver IC integrates a programmable address construction unit. The controller generates a control signal data to control the LED devices, and the control signal data includes an address code and three color codes.

The address construction unit stores an address code. The address construction unit is electrically connected to the RGB LED chips. When the driver IC receives the control signal data from the controller, the driver IC compares the address code of the control signal data with the address code of the address construction unit. When the driver IC determines that the address code of the control signal data matches the address code of the address construction unit, the driver IC controls the LED chips according to the color codes of the external control signal. Namely, a user can control the LED devices through the external controller.

Further, since the address codes of the LED devices are built inside the LED devices, the controller can transmit a plurality of control signals to control each of the LED devices based on the address codes of the LED devices to perform any color combination for each LED device. The LED devices can be controlled to perform any picture frame or dynamic lighting effects.

However, when any one of the LED devices of the lighting system is abnormal, the dynamic lighting effects of the lighting system may be affected. The user has to replace the abnormal LED device with a new LED device. Since the controller only stores the address code of the previously abnormal LED device in the memory, and the controller can only recognize the LED devices having the address codes stored in the memory, the controller cannot recognize the new LED whose address code is not stored in the memory. That is, when the new LED device does not have the exactly same address code as the address code of the abnormal LED device, the LED system cannot operate normally. The controller can perform the complete dynamic lighting effects normally only when the new LED device has an exactly same address code as the address code of the abnormal LED device. Therefore, the controller cannot transmit any control signal corresponding to the new LED device without the exactly same address code. However, it is not possible to prepare a spare LED device having a same address code for each LED device, which will drastically increase cost and need a professional operator to find the right address code and replace the LED device.

Namely, the lighting system cannot be easily fixed by the user, as the user needs to find a manufacturer/distributor of the lighting system to fix the lighting system. It is very inconvenient for the user. Therefore, the conventional lighting system needs to be further improved.

SUMMARY OF THE INVENTION

The present invention provides an LED lighting system, an LED device, and an address assigning method performed by a main controller of the LED lighting system. The LED lighting system includes a plurality of LED devices and the main controller. The LED devices are electrically connected in parallel, and each LED device includes an LED lighting unit, an LED processing unit, and an LED memory unit. The LED processing unit is electrically connected to the LED lighting unit to control the LED lighting unit, and the LED memory unit is electrically connected to the LED processing unit. The main controller is electrically connected to the LED devices, and includes a main processing unit. The main processing unit determines whether a total consumption of the LED devices increases by a first predetermined value, and when the total consumption increases by the first predetermined value, the main processing unit generates an address writing signal, and sends the address writing signal to the LED devices.

Furthermore, when the LED device receives the address writing signal, the LED processing unit of the LED device determines if the LED memory unit is in an empty state. When the LED memory unit is in the empty state, the LED processing unit writes an address code into the LED memory unit according to the address writing signal.

The address assigning method, performed by the main controller, includes the following steps:

determining whether a total consumption of a plurality of LED devices increases by a first predetermined value;

when the total consumption increases by the first predetermined value, generating an address writing signal, and sending the address writing signal to the LED devices.

When a new LED device is installed into the LED lighting system, the total consumption of the LED devices is bound to increase by the first predetermined value due to the basic consumption of the new LED device. The first predetermined value is preset according to the basic consumption value of an LED device. That is, when the main processing unit detects a total consumption increases by the first predetermined value, it is assumed that a new LED device is installed. The main processing unit then generates and sends the address writing signal to the LED devices.

On the other hand, when the LED devices receive the address writing signal through the parallel connection, each LED processing unit determines if its LED memory unit is in the empty state, and only an LED device with an empty LED memory unit will accept the LED writing signal and write the address code into its LED memory unit. A system-recognized address code is thereby given to the new LED device.

When the user adds a new LED device to the system, or a malfunctioning LED device in the lighting system requires replacement, the main processing unit will detect the installation of a new LED light according to the total consumption, and automatically sends the address writing signal to the LED devices. Since the LED devices that are installed beforehand already possess an address code and the LED memory units are not in an empty state, when the LED devices receive the same address writing signal through the parallel connection, only the newly installed LED device will accept the address writing signal and store the address code. Therefore, every LED device will be given an unique address code upon installing.

Therefore, the user does not need to learn the address code of the former malfunctioning LED device to replace it with a new one with the exact same address code. The main processing unit will give the new LED device the unique address code, and therefore can control each LED device with the unique address code. The user can add a new LED device to the lighting system or replace a malfunctioning LED device without requesting help from the manufacturer/distributor.

DETAILED DESCRIPTION OF THE INVENTION

Figure 1:
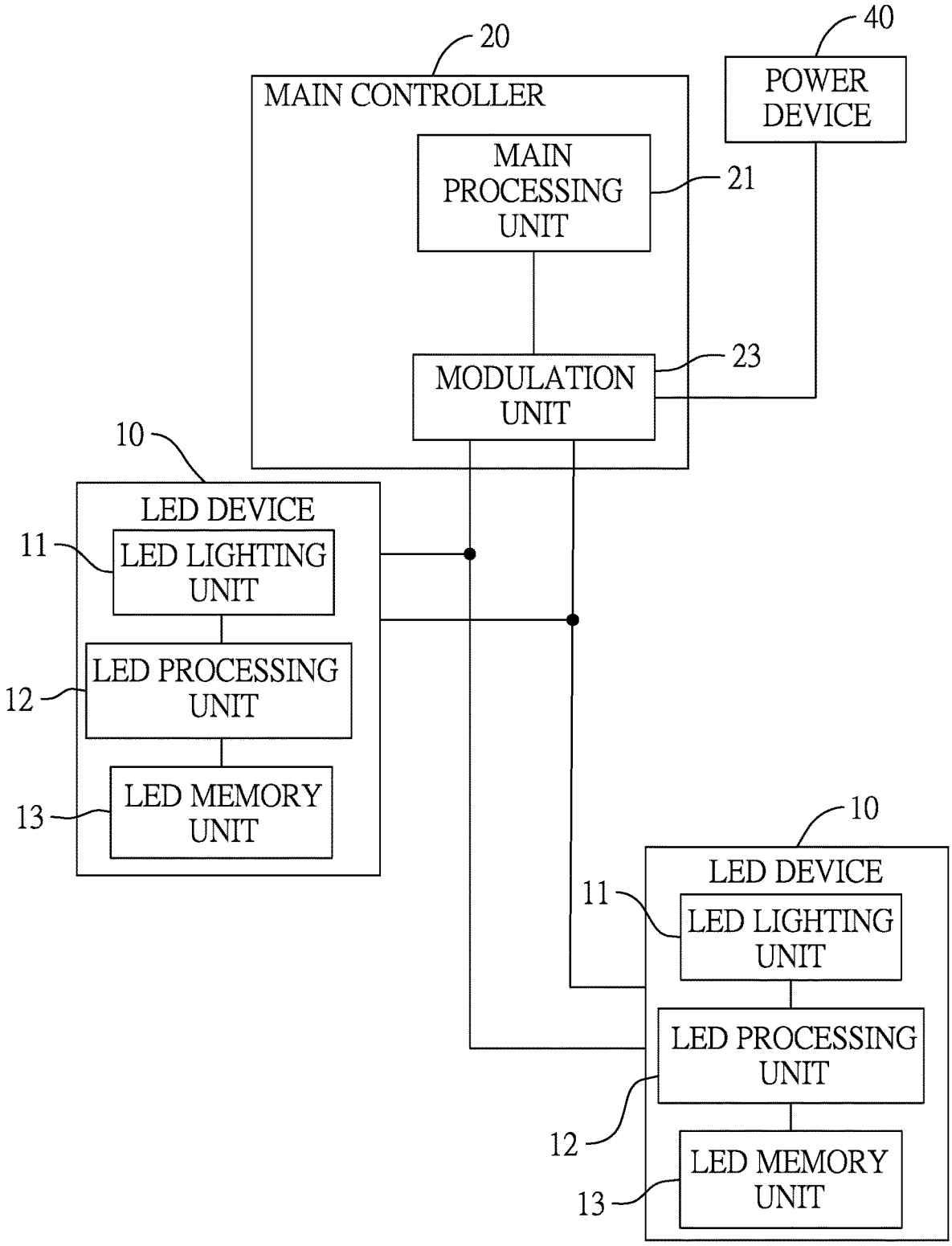
FIG. 1 is a block diagram of a first embodiment of an LED lighting system of the present invention.

With reference to FIG. 1, in a first embodiment of the present invention, an LED lighting system includes a plurality of LED devices 10 and a main controller 20. The LED devices 10 are electrically connected in parallel, and each LED device 10 includes an LED lighting unit 11, an LED processing unit 12, and an LED memory unit 13. The LED processing unit 12 is electrically connected to the LED lighting unit 11 to control the LED lighting unit 11, and the LED memory unit 13 is electrically connected to the LED processing unit 12.

The main controller 20 is electrically connected to the LED devices 10 and includes a main processing unit 21. The main processing unit 21 detects a total consumption of the LED devices 10, and when the main processing unit 21 detects an increase of the total consumption of the LED devices 10 by a first predetermined value, the main processing unit 21 generates an address writing signal, and sends the address writing signal to the LED devices 10.

Furthermore, when the LED devices 10 receive the address writing signal, the LED processing unit 12 of each LED device 10 determines if the LED memory unit 13 is in an empty state. When the LED memory unit 13 is in the empty state, the LED processing unit 12 writes an address code into the LED memory unit 13 according to the address writing signal.

Figure 2:
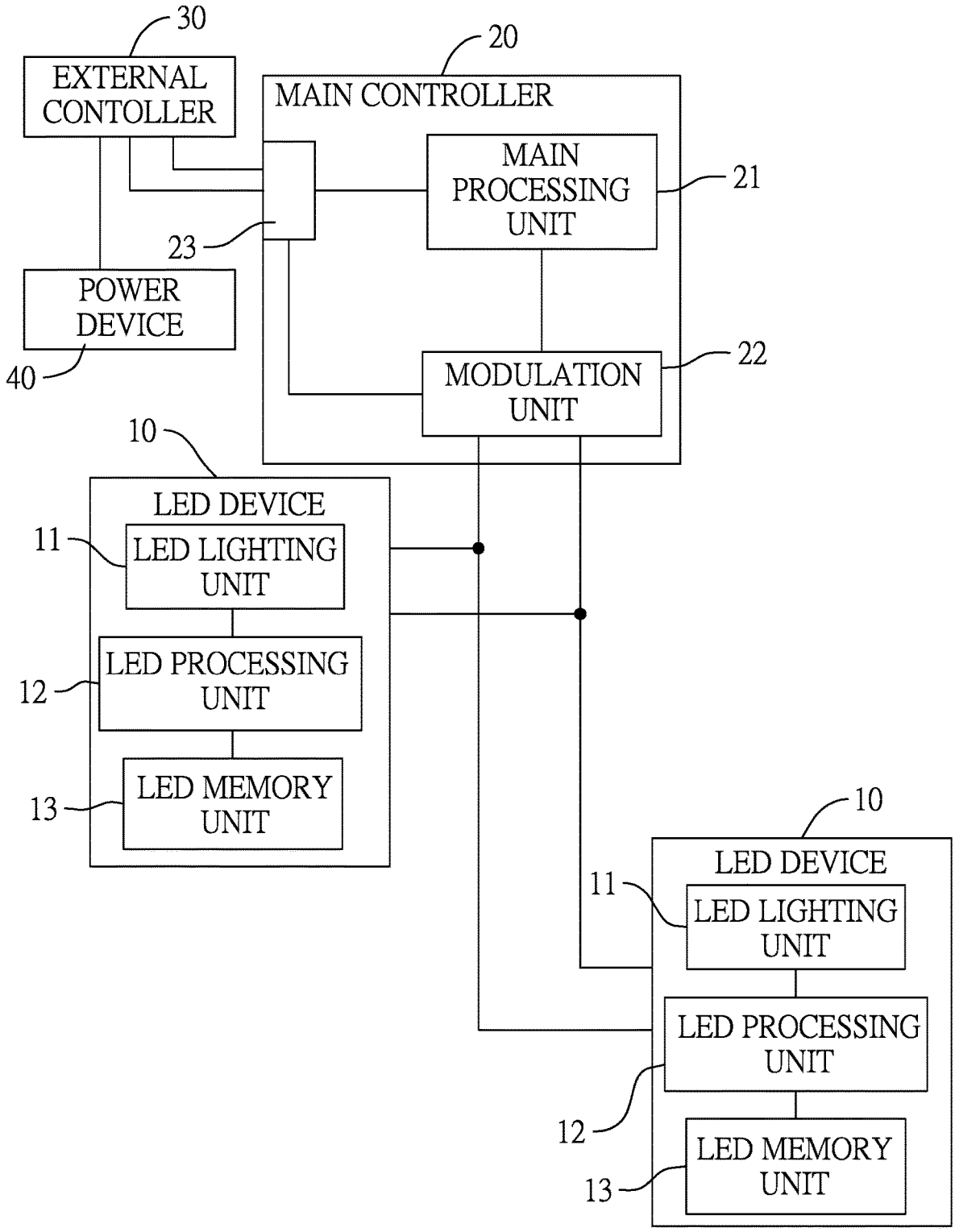
FIG. 2 is a flowchart of an address writing method for the LED lighting system of the present invention.

With reference to FIG. 2, an address assigning method performed by the main controller includes the following steps:

S101: determining whether a total consumption of a plurality of LED devices 10 increases by a first predetermined value;

S102: when the total consumption increases by the first predetermined value, generating an address writing signal, and sending the address writing signal to the LED devices 10.

Preferably, the main controller 20 further includes a modulation unit 22, which is electrically connected to a power device 40. The main processing unit 21 is electrically connected to the LED devices 10 through the modulation unit 22. The modulation unit 22 modulates signals from the main processing unit 21 and the electric power from the power device 40, and transmits the modulated signal on power lines to the LED devices 10. That is, the address writing signals, testing signals and other control signals are transmitted to the LED devices 10 on the power lines. The LED lighting system requires only two connection wires to transmit both the electric power and signals to the LED devices 10, which simplifies the deployment of the LED devices 10.

Preferably, the LED memory unit 13 of each LED device 10 is a programmable read-only memory (PROM), including a plurality of address recording fuse bits. Address codes are written in to the LED memory unit 13 by trimming technology. Furthermore, the LED memory unit 13 may also include at least one state recording fuse bit. When the LED processing unit 12 receives an address writing signal, the LED processing unit 12 reads the at least one state recording fuse bit, and determines if the at least one state recording fuse bit is in an unwritten state. If the at least one state recording fuse bit is in an unwritten state, the LED processing unit determines the LED memory unit is in an empty state. When the LED memory unit is in the empty state and the LED processing unit 12 writes the address code into the LED memory unit 13, the LED processing unit 12 changes the at least one state recording fuse bit to a written state at the same time. The state of the state recording fuse bit may be changed also by trimming technology.

Since the address codes are written into the LED device upon installing, the LED devices are manufactured with an empty LED memory unit, thereby simplifying the manufacture process and lowering the manufacture cost.

Preferably, the main processing unit 21 stores an address table, the address table containing a plurality of sequence codes, and a plurality of address codes corresponding to the sequence codes. Each sequence code represents an LED device 10 arranged in the corresponding location order.

When the LED lighting system is in an installation mode, the main processing unit 21 generates the address writing signal containing the address code corresponding to the sequence code determined according to an installation order of the LED device 10. For instance, when the user installs the first LED device 10 to the lighting system, the main processing unit 21 generates the address writing signal containing the first address code corresponding to the first sequence code in the address table, and sends the address writing signal containing the first address code to the LED device 10; when the user installs the second LED device 10 to the lighting system, the main processing unit 21 generates the address writing signal containing the second address code corresponding to the second sequence code in the address table, and sends the address writing signal containing the second address code to the LED device 10.

As for the user, in the installation phase, the user may install the LED devices 10 one by one into each location of the LED lighting system. For instance, the LED device 10 installed firstly in the first location will be given the first address code, and the LED device 10 installed secondly in the second location, which may be next to the first location, will be given the second address code, and so on. Therefore, the user can simply mount each LED device 10 into each sequenced location and the LED devices 10 will be given the sequenced address codes automatically.

After completing the installation and entering a working mode of the LED lighting system, the main processing unit 21 may generate lighting control signals based on the address table.

Figure 3:
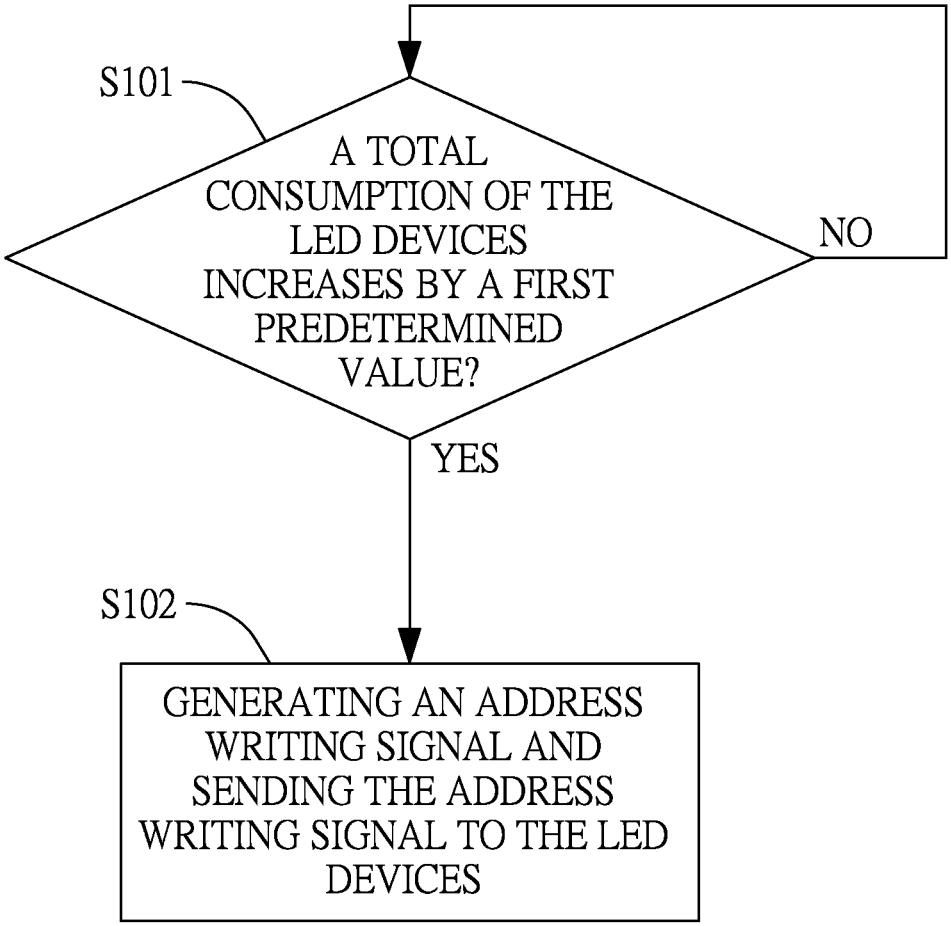
FIG. 3 is a block diagram of a second embodiment of an LED lighting system of the present invention.

With reference to FIG. 3, in a second embodiment, the main controller further includes a connection port 23, which is connected to an external controller 30. The main processing unit 21 is connected to the connection port 23 and electrically connected to the external controller 30 through the connection port 23. When the main processing unit 21 receives an external control signal from the external controller, the main processing unit 21 decodes the external control signal, and generates a converted control signal accordingly. The converted control signal contains an address code and a color code. The converted control signal is then sent to the LED devices 10.

The address table of the main processing unit 21 further includes external address codes of the external controller. That is, the main processing unit 21 builds the address table with corresponding external address codes, sequence codes, and address codes in it. When the man processing unit 21 decodes the external control signal, the main processing unit 21 may obtain an external address code and an external color code. The main processing unit 21 further looks up the address table and finds the corresponding address code, and generates the converted control signal containing an address code and a color code.

In another embodiment, the main processing unit 21 stores the address codes as the shifted version of the external address code. Therefore, the main processing unit 21 may find the corresponding address code in the address table by decoding and shifting the external control signal.

The external controller 30 may be a native lighting system controller that runs a DMX512 standard protocol, and has an output port with a 5-pin DMX512 standard output port. As shown in FIG. 3, since the DMX512 standard output port includes a power connection pin, the modulation unit is also connected to the connection port and electrically connected to the power device through the external controller. Preferably, the main processing unit 21 is embedded with DMX512 protocol decoder in order to interpret the signals from the external controller 30. When the LED lighting system receives the external control signal from the external controller 30, the main processing unit 21 decodes the external control signal to obtain the address code and the color code, and therefore controls the LED devices 10 according to the lighting patterns or dynamic lighting effects required by the external controller 30.

As a result, there is no need for the user to learn the addressing protocol of the external controller 30 or the lighting system in the process. The user may simply connect the external controller 30 to the connection port 23 of the lighting system, and the lighting system can automatically transform the external control signal to the converted control signal for the LED devices 10, which is therefore convenient and easy for the user. The applicability of the lighting system is therefore highly improved.

When the LED lighting system is in a replacement mode, before the main processing unit 21 determines whether the total consumption increases, the main processing unit 21 determines if the total consumption decreases by the first predetermined value. When the total consumption decreases by the first predetermined value, the main processing unit sends a testing signal to the LED devices 10. The testing signal includes an address code. The main processing unit 21 then determines if one of the LED devices 10 is absent according to the response of the LED devices 10 to the testing signal. If the main processing unit 21 determines that one of the LED devices 10 is absent according to the response, the main processing unit 21 further determines if the total consumption of the LED devices 10 increases by the first predetermined value, and only when the total consumption of the LED devices 10 increases by the first predetermined value, the main processing unit 21 sends the address writing signal to the LED devices 10 with the same address code as the testing signal.

Figure 4:
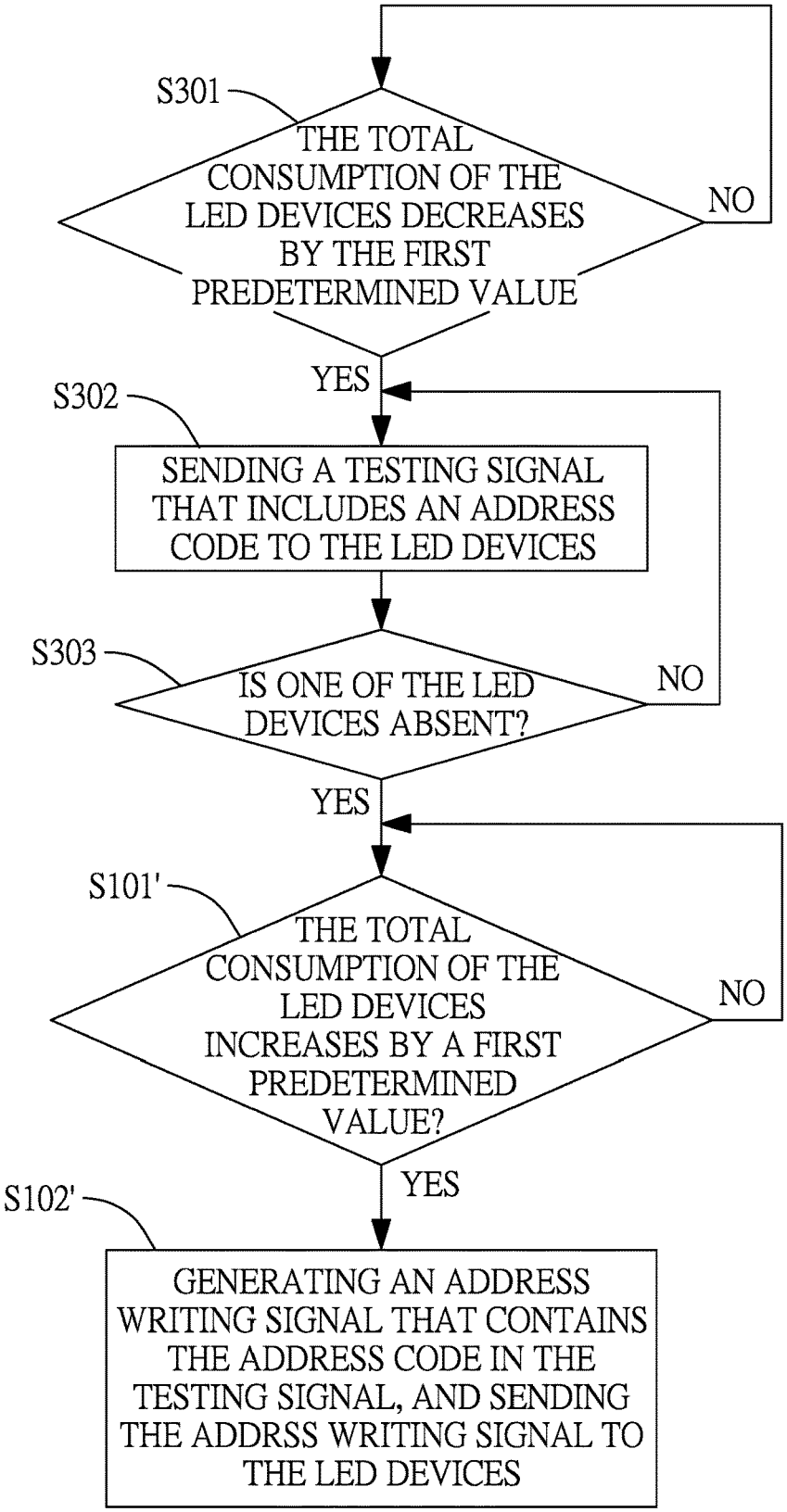
FIGS. 4 and 5 are flowcharts of embodiments of an address writing method for a LED lighting system of the present invention.

With reference to FIG. 4, in the present embodiment, the address assigning method further includes the following steps before step S101:

S301: determining whether the total consumption of the LED devices 10 decreases by the first predetermined value;

S302: when the total consumption decreases by the first predetermined value, sending a testing signal that includes an address code to the LED devices 10:

S303: determining whether one of the LED devices 10 is absent according to a response of the LED devices 10; wherein S101': when one of the LED devices 10 is absent, further determining whether the total consumption of the LED devices 10 increases by the first predetermined value;

S102': when one of the LED device 10 is absent and the total consumption of the LED devices 10 increases by the first predetermined value, generating the address writing signal that contains the address code contained in the testing signal, and sending the address writing signal to the LED devices 10.

In the present embodiment, before the main processing unit 21 detects the installation of a new LED device 10, the main processing unit 21 first detects the removal of one of the LED devices 10 by determining if the total consumption decreases by the first predetermined value. When the total consumption decreases, it is assumed that one of the LED devices 10 is removed. The main processing unit 21 then further generates and sends the testing signal that contains the address code to the LED devices 10, and determines if one of the LED devices 10 is absent according to the response of the LED devices 10. When the main processing unit 21 determines that one of the LED devices 10 is absent, the main processing unit 21 further determines if the total consumption increases by the first predetermined value, and generates the address writing signal that contains the address code contained in the testing signal when the total consumption increases.

When the main processing unit 21 determines none of LED devices 10 is absent, the main processing unit 21 may generate another testing signal containing the next address code in the address table, until the main processing unit 21 finds the LED device 10 that is removed.

In the present embodiment, the main processing unit 21 detects the removal of one of the LED devices 10, determines the identity of the removed LED device 10 by sending testing signals with address codes, and generates the address writing signal with the address code of the removed LED device 10 for the new LED device 10. Therefore, the lighting control method and controlling process after replacing an LED device require no adjustment or data base rewriting in the external controller 30 or the main processing unit 21, since the new LED device 10 has the same address code as the removed one.

As for the user, when the user finds any one of LED devices is not working normally, the user may simply switch the LED lighting system to the replacement mode, remove the malfunctioning LED device, and mount a new LED device to the empty location. In the replacing operation, the main controller will automatically detect the removal of the old LED device, identify the removed LED device, and give the new LED device the exact same address code as the removed LED device to the new LED device. When the LED lighting system is switched back to the working mode, the new LED device can work identically to the old LED device.

Preferably, the main processing unit 21 determines if any one of the LED devices 10 is absent by determining whether the total consumption increases by a second predetermined value. That is, when the main processing unit 21 sends the testing signal to the LED devices 10, the main processing unit 21 determines the whether the total consumption increases by a second predetermined value. When the total consumption does not increase by a second predetermined value, the main processing unit 21 determines that one of the LED devices 10 is absent.

Figure 5:
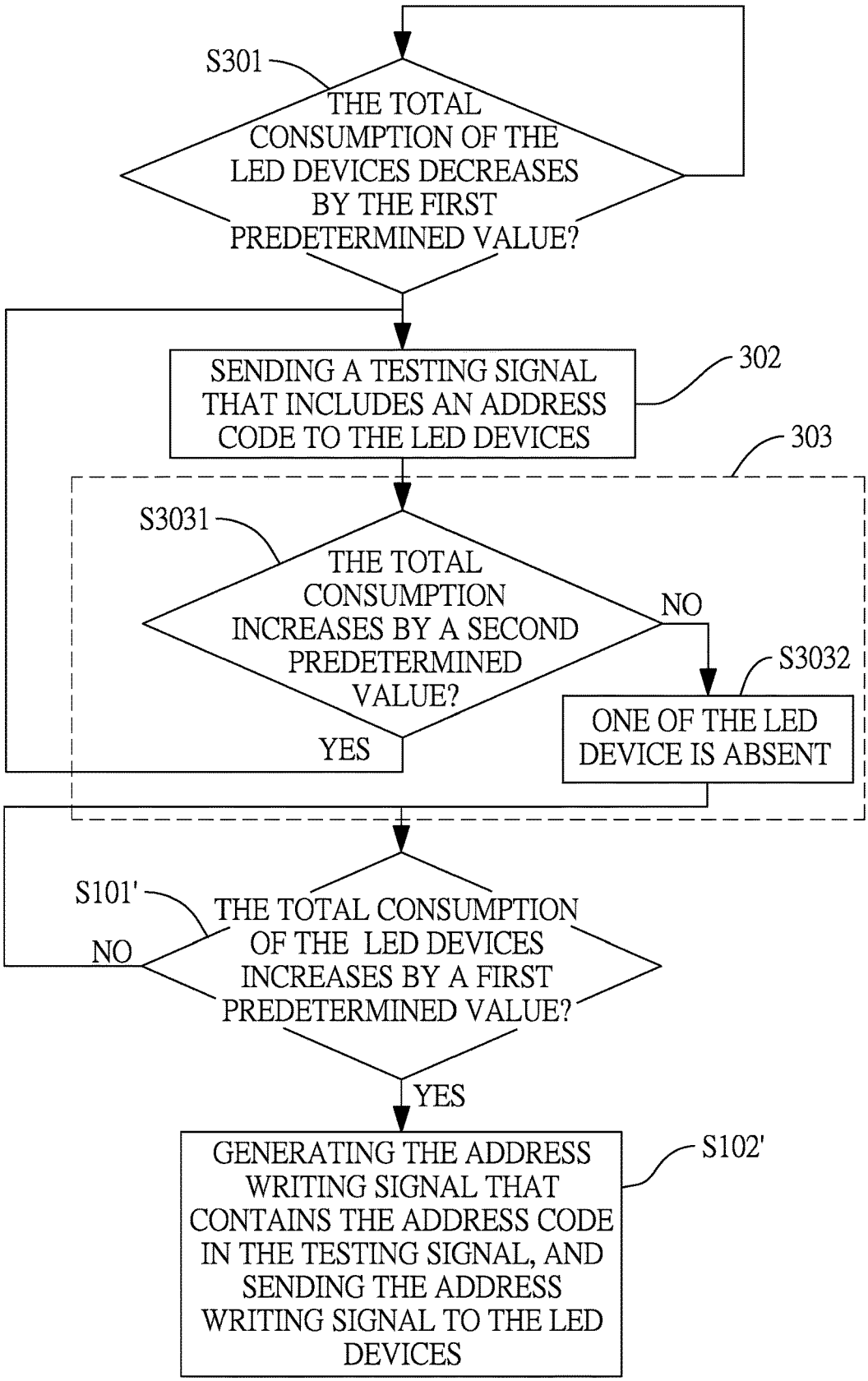

With reference to FIG. 5, the step of determining whether one of the LED devices 10 is absent according to a response of the LED devices 10 (S303) is performed according to the following sub-steps:

determining whether the total consumption increases by a second predetermined value (S3031);

when the total consumption doesn't increase by the second predetermined value, determining that one of the LED devices 10 is absent (S3032).

The testing signal has the address code and a color code. When the LED device 10 receives the testing signal, the LED device 10 determines whether the address code in the testing signal matches the address code in the LED memory unit 13. When the address code matches, the LED processing unit 12 controls the lighting unit 11 according to the color code.

The main processing unit 21 is able to control the LED devices 10 with the testing signal by generating the address code and color code. The LED device 10 having the same address code as the testing signal will respond to the testing signal and control the lighting unit 11 with certain color light. When an LED lighting unit 11 lights up, the total consumption of the LED devices 10 will increase by a certain value, for instance, 10 mA. Therefore, if the total consumption of the LED devices 10 increases by 10 mA when the main processing unit 21 sends the testing signal, the LED device 10 having the specific address code is in place and working normally. On the contrary, if the total consumption does not increase by 10 mA, it is assumed that one of the LED devices 10 is absent, and it is also confirmed that the LED device having the specific address code in the testing signal removed and therefore absent.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A light-emitting diode (LED) lighting system, comprising:

a plurality of LED devices, electrically connected in parallel, and each comprising:

an LED lighting unit;

an LED processing unit, electrically connected to the LED lighting unit, and controlling the LED lighting unit;

an LED memory unit, electrically connected to the LED processing unit;

a main controller, comprising:

a main processing unit; wherein the main processing unit determines whether a total consumption of the LED devices increases by a first predetermined value; when the total consumption increases by the first predetermined value, the main processing unit generates an address writing signal, and sends the address writing signal to the LED devices;

when each LED device receives the address writing signal, the LED processing unit of the LED device determines if the LED memory unit is in an empty state;

when the LED processing unit determines that the LED memory unit is in the empty state, the LED processing unit writes an address code contained in the address writing signal into the LED memory unit.

2. The LED lighting system as claimed in claim 1, wherein the main controller stores an address table comprising a plurality of sequence codes and a plurality of address codes corresponding to the sequence codes;

wherein the main processing unit generates the address writing signal containing the address code corresponding to the sequence code according to an installation order of the LED device.

3. The LED lighting system as claimed in claim 1, wherein before the main processing unit determines whether the total consumption increases by the first predetermined value, the main processing unit determines whether the total consumption of the LED devices decreases by the first predetermined value; when the total consumption decreases by the first predetermined value, the main processing unit sends a testing signal that contains an address code to the LED devices, and the main processing unit determines whether one of the LED devices is absent according to a response of the LED devices; wherein when one of the LED devices is absent, the main processing unit further determines if the total consumption of the LED devices increases by the first predetermined value;

when one of the LED devices is absent and the total consumption increases by the first predetermined value, the main processing unit sends the address writing signal containing the address code contained in the testing signal to the LED devices.

4. The LED lighting system as claimed in claim 3, wherein when the main processing unit sends the testing signal to the LED devices, the main processing unit determines whether the total consumption increases by a second predetermined value;

when the total consumption doesn't increase by the second predetermined value, the main processing unit determines that one of the LED devices is absent.

5. The LED lighting system as claimed in claim 4, wherein the main controller further comprises:

a connection port, electrically connected to the main processing unit and an external controller; wherein the main processing unit is electrically connected to the external controller through the connection port, and when the main processing unit receives an external control signal from the external controller, the main processing unit decodes the external control signal, generates a converted control signal containing an address code and a color code according to the decoded external control signal, and sends the converted control signal to the LED devices.

6. The LED lighting system as claimed in claim 5, wherein the external controller is a lighting system controller embedded with DMX512 standard protocol.

7. The LED lighting system as claimed in claim 1, wherein the LED memory unit is a programmable read-only memory, comprising a plurality of address recording fuse bits.

8. The LED lighting system as claimed in claim 6, wherein the LED memory unit further comprises at least one state recording fuse bit; wherein when the LED processing unit receives the address writing signal, the LED processing unit reads the at least one state recording fuse bit, and determines if the at least one state recording fuse bit is in an unwritten state;

when the at least one state recording fuse bit is in the unwritten state, the LED processing unit determines the LED memory unit is in the empty state;

when the LED processing unit writes the address code in the address writing signal into the LED memory unit, the LED processing unit changes the at least one state recording fuse bit to a written state.

9. The LED lighting system as claimed in claim 4, wherein the testing signal includes the address code and a color code;

when the LED device receives the testing signal, the LED processing unit determines whether the address code in the testing signal matches the address code stored in the LED memory unit;

when the address code in the testing signal matches the address code in the LED memory unit, the LED main processing unit controls the lighting unit according to the color code in the testing signal.

10. The LED lighting system as claimed in claim 7, further comprising:

a modulation unit; wherein the main processing unit is electrically connected to the LED devices through the modulation unit;

wherein the modulation unit is electrically connected to a power device, and the modulation unit modulates signals from the main processing unit and electric power from the power device.

11. An address assigning method for an LED lighting system, performed by a main controller of the LED lighting system, comprising the steps of:

determining whether a total consumption of a plurality of LED devices increases by a first predetermined value; and when the total consumption increases by the first predetermined value, generating an address writing signal, and sending the address writing signal to the LED devices;

wherein one of the LED devices with an empty LED memory unit writes an address code into the LED memory unit according to the address writing signal;

wherein the first predetermined value is preset according to a basic consumption value of each of the LED devices.

12. The address assigning method as claimed in claim 11, wherein the main controller stores an address table, comprising a plurality of sequence codes and a plurality of address codes corresponding to the sequence codes;

wherein the address writing signal contains an address code corresponding to a sequence code determined according to an installation order of the LED device.

13. The address assigning method as claimed in claim 11, wherein before the step of determining whether a total consumption of a plurality of LED devices increases by a first predetermined value, the method further comprises the steps of:

determining whether the total consumption of the LED devices decreases by the first predetermined value;

when the total consumption decreases by the first predetermined value, sending a testing signal that includes an address code to the LED devices:

determining whether one of the LED devices is absent according to a response of the LED devices; wherein when one of the LED devices is absent, further determining whether the total consumption of the LED devices increases by the first predetermined value; and when one of the LED devices is absent and the total consumption of the LED devices increases by the first predetermined value, generating an address writing signal that contains the address code same as the address code in the testing signal, and sending the address writing signal to the LED devices.

14. The address assigning method as claimed in claim 13, wherein the step of determining whether one of the LED devices is absent according to a response of the LED devices comprises the following sub-steps:

determining whether the total consumption increases by a second predetermined value;

when the total consumption doesn't increase by the second predetermined value, determining that one of the LED devices is absent.

15. An LED device, comprising:

an LED lighting unit;

an LED processing unit, electrically connected to the LED lighting unit, and controlling the LED lighting unit;

an LED memory unit, electrically connected to the LED processing unit; wherein when the LED device receives an address writing signal, the LED processing unit determines if the LED memory unit is in an empty state;

when the LED processing unit determines that the LED memory unit is in the empty state, the LED processing unit writes an address code contained in the address writing signal into the LED memory unit.

16. The LED device as claimed in claim 15, wherein the LED memory unit is a programmable read-only memory, comprising a plurality of address recording fuse bits.

17. The LED device as claimed in claim 15, wherein the LED memory unit further comprises at least one state recording fuse bit;

when the LED processing unit receives the address writing signal, the LED processing unit reads the at least one state recording fuse bit, and determines if the at least one state recording fuse bit is in an unwritten state;

if the at least one state recording fuse bit is in the unwritten state, the LED processing unit determines the LED memory unit is in an empty state;

when the LED processing unit writes the address code into the LED memory unit, the LED processing unit changes the at least one state recording fuse bit to a written state.

* * * * *